United States Patent [19]

Heilhecker et al.

[11] 4,051,456

[45] Sept. 27, 1977

[54] APPARATUS FOR ESTABLISHING AND MAINTAINING ELECTRIC CONTINUITY IN DRILL PIPE

[75] Inventors: Joe K. Heilhecker; Everett H. Lock; Fred H. Deily, all of Houston, Tex.

[73] Assignee: Exxon Production Research Company, Houston, Tex.

[21] Appl. No.: 638,715

[22] Filed: Dec. 8, 1975

[51] Int. Cl.[2] ..... G01V 1/40

[52] U.S. Cl. ..... 340/18 LD; 340/18 CM; 175/50; 175/104; 33/312

[58] Field of Search ..... 340/18 LD, 18 CM; 175/40, 50, 104; 33/312

[56] References Cited

U.S. PATENT DOCUMENTS

| | | | |
|---|---|---|---|
| 2,349,225 | 5/1944 | Scherbatskoy et al. | 340/18 CM |
| 2,569,390 | 9/1951 | Sewell | 340/18 LD |
| 2,650,067 | 8/1953 | Martin | 340/18 LD |
| 2,936,614 | 5/1960 | Godby | 340/18 CM |
| 3,285,629 | 11/1966 | Cullen et al. | 175/104 |
| 3,789,936 | 2/1974 | McCullough | 175/50 |
| 3,825,079 | 7/1974 | Heilhecker | 175/40 |
| 3,926,269 | 12/1975 | Cullen et al. | 175/104 |

*Primary Examiner*—Brooks H. Hunt
*Attorney, Agent, or Firm*—Robert L. Graham

[57] ABSTRACT

Apparatus for use in a rotary drill string to maintain electric continuity therethrough includes an externally insulated electric conductor tube having an electric cable mounted therein. The cable is telescopically movable with respect to the tube, and its lower end is in sliding contact with the interior of the tube. As drilling progresses, the cable may be extended relative to the tube, the sliding contact of the lower end of the cable maintaining electric continuity in the system.

11 Claims, 4 Drawing Figures

APPARATUS FOR ESTABLISHING AND MAINTAINING ELECTRIC CONTINUITY IN DRILL PIPE

BACKGROUND OF THE INVENTION

1. Field of the Invention

This invention relates to an improved apparatus for establishing and maintaining electric continuity within a drill string using an insulated electric conductor. The invention can be employed in wellbore telemetry operations and other operations wherein it is desired to transmit electric energy between the surface and a subsurface location in a well, including electric drilling operations.

2. Description of the Prior Art

In the drilling of oil wells, gas wells, and similar boreholes, it frequently is desirable to transmit electric energy between subsurface and surface locations. One application where electrical transmission has received considerable attention in recent years is found in wellbore telemetry systems designed to sense, transmit, and receive information indicative of a subsurface condition. This operation has become known in the art as "logging while drilling". A major problem associated with wellbore telemetry systems proposed in the past has been that of providing reliable means for transmitting an electric signal between the subsurface and surface locations. This problem can best be appreciated by considering the manner in which rotary drilling operations are normally performed. In rotary drilling, a borehole is advanced by rotating a drill string provided with a bit. Lengths of drill pipe, usually about 30 feet long, are individually added to the drill string as the borehole is advanced. In adapting an electrical telemetry system to rotary drilling equipment, it will thus be appreciated that the means for transmitting an electric signal between subsurface and surface locations must be such as to permit the connection of additional pipe lengths to the drill string.

An early approach to the problem involved the use of a continuous electrical cable which was adapted to be lowered inside the drill string and to make contact with a subsurface terminal. This technique, however, required withdrawing the cable each time an additional pipe section was connected to the drill string. Another approach involves the use of special drill pipe equipped with an electric conductor. Each pipe section is provided with connectors that mate with connectors of an adjacent pipe section and thereby provide an electrical circuit across the joint (See U.S. Pat. Nos. 3,518,608 and 3,518,609). Disadvantages of this system include the high cost of special pipe sections, the use of a large number of electric connectors (one at each joint), and the difficulty of maintaining insulation of the electric connectors at each joint.

Still another approach proposed for use in wellbore telemetry systems involves the use of cable sections mounted in each pipe section (see U.S. Pat. No. 2,748,358). The cable sections are connected together as pipe sections are added to the drill string. Each cable section is normally made slightly longer than its associated pipe section, with the result that a small amount of slack is present in the conductor string at all times. For long pipe strings and long conductor strings, the excess can be quite considerable and can present problems such as entanglement or restricting flow through the pipe string.

A more recent approach to wellbore telemetry involves the use of an insulated conductor maintained in a configuration to store conductor cable within the pipe string (see U.S. Pat. No. 3,825,078). In accordance with the preferred embodiment of this concept as disclosed in this patent, the conductor cable is arranged in a looped, overlapped configuration, the length of the overlap providing stored cable sections. The looped configuration of the cable permits the cable to be extended as the drill string is extended. This technique normally requires the use of guides and other apparatus within the drill string to maintain the cable in the looped configuration and to permit cable withdrawal from the drill string at the desired times. The looped cable arrangement presents certain problems. For long loop sections, extreme care must be exercised to prevent cable twisting and entanglement. Moreover, the arrangement somewhat restricts the type of cable that may be employed since it must be capable of being bent around relatively small guides.

Another application which requires the maintenance of electric continuity between the surface and subsurface in a drill string is found in electric drilling. Electric drilling apparatus usually involves a bit provided with a downhole electric motor and a cable for delivering power to the motor. An advantage of electric drilling over conventional rotary drilling is that the power is delivered at the bit and does not require rotation of the entire drill string. A problem associated with electric power systems, however, involves the electric cable for delivering power from a surface power source to the downhole electric motor. In the past, a continuous flexible pipe string having an internal electric cable has been used (see U.S. Pat. No. 3,285,629). This system requires coiling of the pipe string and internal cable at the surface and is not readily adaptable to conventional operations.

SUMMARY OF THE INVENTION

The purpose of the present invention is to provide a communication, or power link, between a subsurface location in a well and the surface. The invention is particularly adapted to use in wellbore telemetry operations and electric drilling operations.

The apparatus constructed according to the present invention includes an externally insulated conductor tube adapted to be mounted in a pipe string and having its lower end in electrical communication with a subsurface terminal of an electric motor, a downhole instrument, or a sensing device. Mounted within the tube is a conductor wire having its lower end in sliding contact with the interior of the tube and extending upwardly through the upper end of the tube and to a surface terminal. The wire and tube are telescopically movable such that as drilling proceeds and the well is deepened, electric communication is maintained by the tube being moved downwardly with respect to the wire, the sliding contact of the wire on the tube maintaining electric continuity between the subsurface and surface terminals. The invention thus provides stored conductor cable within the drill string but avoids the problem of cable entanglement. Moreover, the invention is not restricted to any particular type of cable.

A particularly attractive feature of the invention is that it is not limited to a flexible conductor wire since no bends are placed in the wire. A heavy duty wire may be employed, increasing the electric conductivity thereof. Moreover, a plurality of conductor wires may be employed making the apparatus ideally suited for electric drilling systems, which normally employ three-phase motors.

DESCRIPTION OF THE PREFERRED EMBODIMENT

Figure 1:
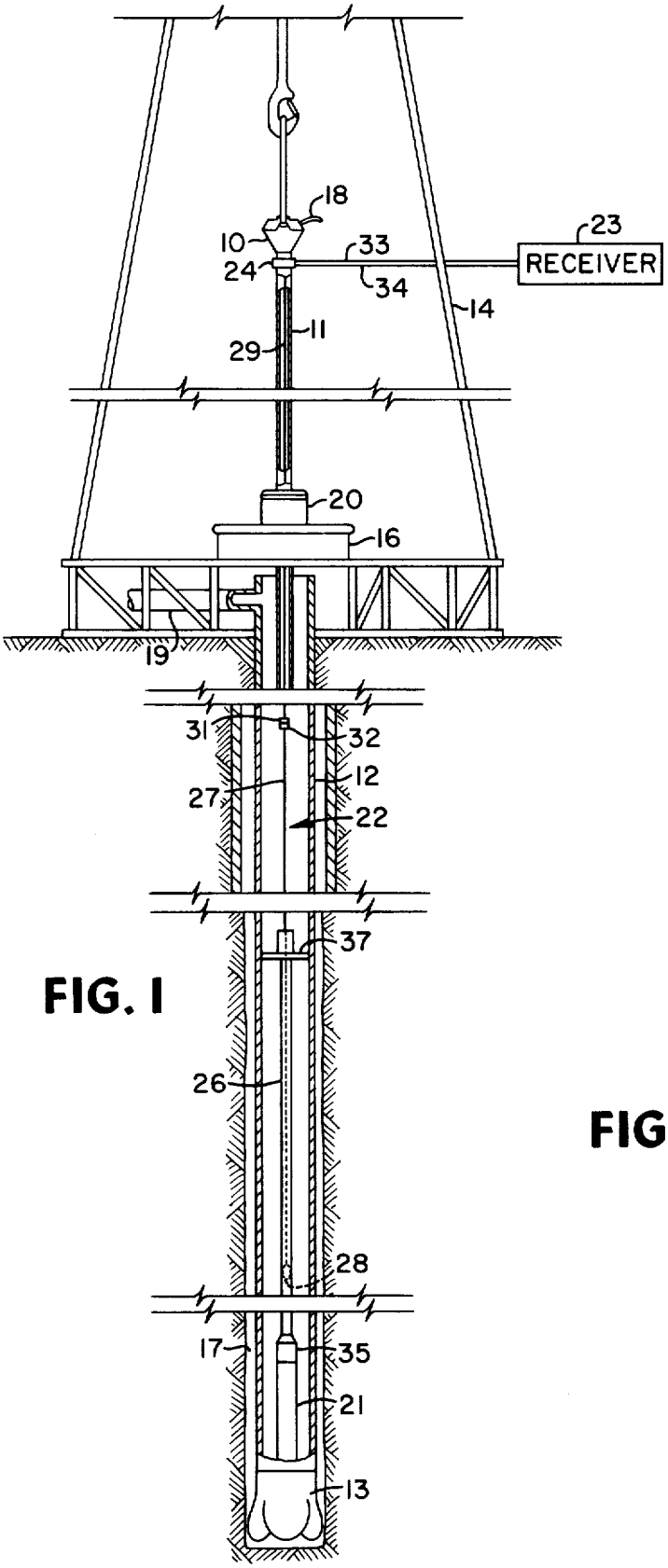
FIG. 1 is a schematic view of a well drilling equipment provided with an electric conductor mounted within a pipe string in accordance with the present invention.

Conventional rotary drilling equipment, as schematically illustrated in FIG. 1, includes swivel 10, kelly 11, tubular drill string 12, and bit 13. These components, connected in the manner illustrated, are suspended from the drilling derrick 14 by means of rig hoisting equipment. The kelly 11 passes through rotary table 16 and connects to the upper end of the drill string 12. The term "drill string" as used herein refers to the column of pipe 12 between the bit 13 and the kelly 11, and the term "pipe string" refers to the complete column of pipe including kelly 11. The major portion of the drill string 12 normally is composed of drill pipe with a lower portion being composed of drill collars. The drill string 12 consists of individual pipe sections connected together in end-to-end relation. (In the lower three sections of FIG. 1, the diameters of the borehole and the drill string 12 have been expanded in relation to the upper section to reveal further details.)

The borehole 17 is advanced by rotating the drill string 12 and bit 13 while at the same time drilling fluid is pumped through the drill string 12 and up the borehole annulus. The drilling fluid is delivered to swivel 10 through a hose attached to connection 18 and is returned to the surface fluid system through pipe 19. A kelly bushing 20 couples the rotary table 16 to the kelly 11 and provides means for transmitting power from the rotary table 16 to the drill string 12 and bit 13. (A power swivel may be used in lieu of the kelly and rotary table. The present invention can be used with either system; for purposes of illustration, however, the invention will be described with reference to the kelly and rotary table system.)

As mentioned previously, it frequently is desirable to monitor a subsurface drilling condition during drilling operations. This requires measuring a physical condition at the subsurface location, transmitting this information as an electrical signal to the surface and reducing the signal to useful form. Typical situations where telemetry is applicable in drilling operations include drilling through abnormal pressure zones, drilling through zones where hole deviation is likely to be a problem, directional drilling, exploratory drilling, and the like.

Although the present invention may be employed in most any drilling operation herein, an electric conductor is used in the pipe string to transmit electric energy between a subsurface location and a surface location. It finds particularly advantageous application in a wellbore telemetry system such as that illustrated in FIG. 1 comprising a subsurface instrument 21, an insulated electric conductor 22, and receiver 23.

The instrument 21 capable of measuring a subsurface condition and generating an electric signal indicative or representative of that condition is provided within the drill string 12. A variety of devices capable of sensing a physical condition are available. These include transducers for measuring pressure, temperature, strain and the like; surveying instruments for measuring hole deviation and direction; and logging instruments for measuring resistivity or other properties of subsurface formations. The instrument 21 may be powered by batteries or by energy transmitted through conductor 22. Alternatively, a subsurface generator driven by fluid flowing through the drill string 12 may be used to power instrument 21.

The method of the present invention relates primarily to the electric conductor 22 employed within the drill string to maintain electric continuity between a subsurface terminal at instrument 21 and a surface terminal connected to receiver 23. The energy transmitted in the circuit may be a signal generated by the subsurface instrument 21 and transmitted to the receiver 23 at the surface. Alternatively, the energy may be electric power transmitted from the surface to actuate or drive a subsurface instrument or motor. Or, energy may be transmitted down the conductor 22 to power the instrument 21, and simultaneously intelligence may be transmitted up the same conductor 22.

As applied in telemetry operations, it is preferred that the energy being transmitted in the form of a pulsating signal. Information can be transmitted by varying the number, amplitude, width or spacing of a train of electrical pulses, or it can be transmitted by modulating the frequency or amplitude of the pulsating signal. More than one transducer or other device may be employed in the instrument 21 if desired, in which case a multiplexer may be used for sending the various signals over a single conductor.

The instrument may be mounted in the drill string 12 or, as illustrated in FIG. 1, it may be a separate tool that is lowered into the drill string 12 on the conductor 22.

The conductor 22 which extends from instrument 21 to the surface comprises conductor tube 26, and the conductor wire 27. The conductor tube 26 is mounted immediately above the instrument 21 and extends upwardly through intermediate portion of the drill string 12. As described in more detail below, the conductor tube 26 is in electric communication with instrument 21 and serves as the electric conductor means from instrument 21 to its upper end. The lower end of conductor wire 27 is maintained in sliding contact with the interior of tube 26 by springs 28 schematically illustrated in FIGS. 1 and 2. The wire 27 extends upwardly through the upper end of the tube 26 substantially to the surface. Preferably, the conductor wire 27 extends through the kelly 11 and connects to a terminal at device 24 located at the upper end of the kelly 11. For reasons described in more detail below, the upper portion of the conductor wire 27 includes kelly conductor wire 29. It should be observed, however, that kelly conductor wire 29 may be embedded in the kelly 11 in which case the conductor wire 29 may extend to the upper end of the drill string 12 and connect to the embedded kelly conductor at that location. In order to facilitate the addition of pipe sections as drilling progresses, it is preferred, however, that the kelly conductor wire 29 be disposed within the kelly 11 (as illustrated) and extend slightly more than the length of one pipe section below the kelly 11 where terminals 31 and 32 interconnect the kelly conductor wire 29 with the rest of the conductor wire 27.

If telemetry operations are to be performed while the kelly 11 and drill string 12 are rotating, the upper end of conductor 22 will be connected to device 24 capable of transmitting electric energy from a rotating member to a stationary member. Device 24 may be a rotary transformer having a rotor secured to the kelly 11 and a stator secured to the stationary portion of the swivel 10, or it may be a slip ring and brush assembly. Device 24 and electric conductor 33 provide means for transmitting signals from the conductor 27 within the pipe string to receiver 23. The return path for the electric circuit may be provided by a variety of grounding circuits but preferably is through the pipe string or conductor armor. Conductor 34 of the return path interconnects stationary portion of device 24 and receiver 23. If telemetry operations are to be performed at times when the drill string 12 and the kelly 11 are stationary or in systems which do not employ a rotating drill string, the conductors 33 and 34 may be connected directly to conductor wire 27 through a suitable connector. Conductors 33 and 34 may be disconnected when the kelly 11 and drill string 12 are being rotated. Other means for transmitting the signal to the receiver 23 include a wireless transmitter connected to conductor wire 27 and located on a rotating member, e.g. kelly 11.

The receiver 23 is an instrument capable of receiving the signal generated by instrument 21 and reducing it to useful form. Such instruments are well known to those skilled in the art and are discussed at length in the literature.

Figure 3A:
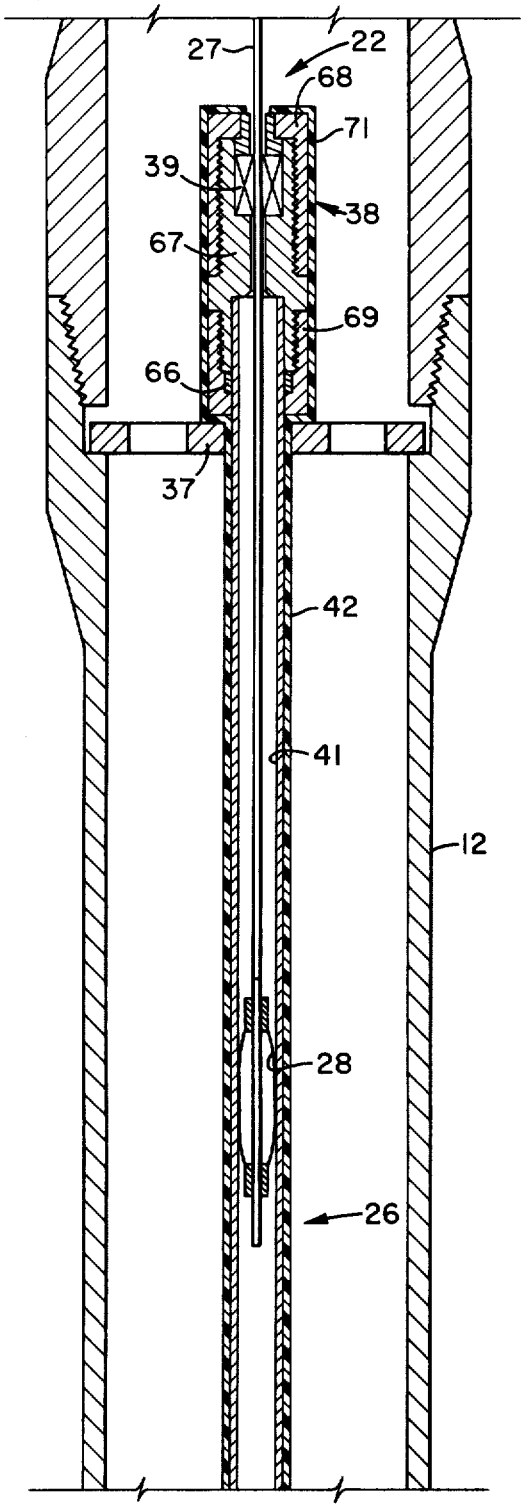
FIGS. 3A and 3B, in combination, present an enlarged fragmentary view of a portion of the conductor string shown in FIGS. 1 and 2 illustrated in longitudinal sectional.
Figure 3B:
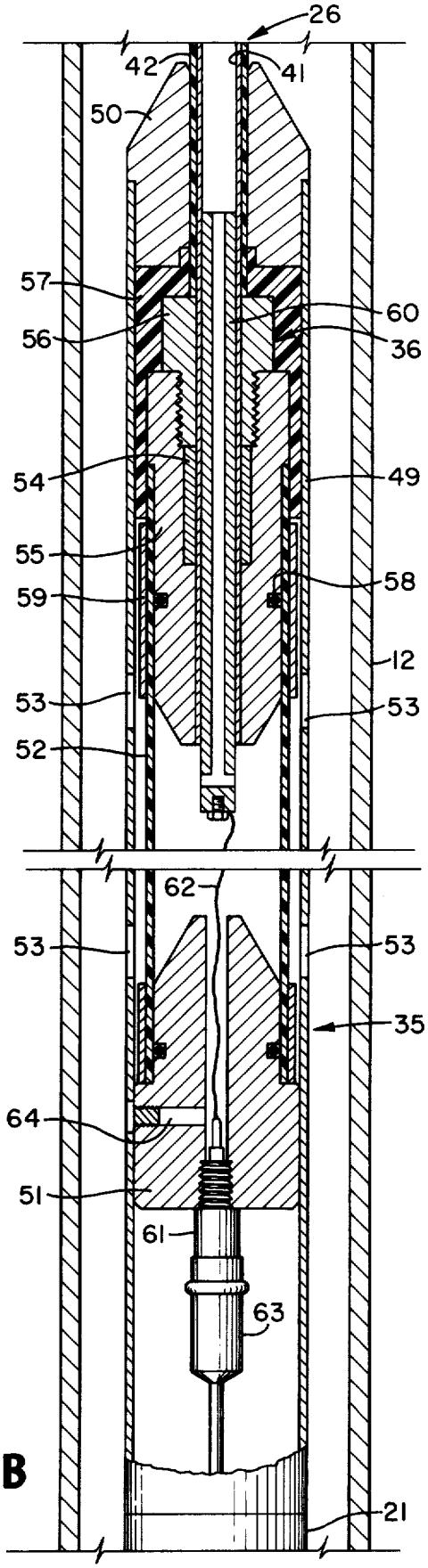

As shown schematically in FIG. 1, and in detail in FIG. 3B, the conductor tube 26 is secured to instrument 21 by a support housing 35. The support housing 35 may be threadedly connected to the upper end of instrument 21 and may be of the same diameter. The tube 26 is mounted in the upper end of the support housing 35 by assembly 36 (described in detail below). The tube 26 extends upwardly within the pipe string 12 and has its upper end 38 secured to the pipe string by support ring or spider 37 (see FIG. 3A). The upper end 38 of tube 26 is enlarged and houses packing assembly 39; enlarged end 38 provides a shoulder adapted to be suspended on spider 37, which in turn is supported within box end of a pipe section in pipe string 12. Other means for supporting the upper end of tube 26 includes hanger assemblies such as those used in packers.

The tube 26 includes an interior metal conductor tube 41 and an outer coating 2 of insulating material such as rubber or plastic. Suitable materials for the tube 41 include a tube of a copper alloy such as beryllium copper. The insulation for the tube can be provided by a heat-shrinkable polyolefin material sold as Thick-Wall Heat Shrink Products by American Pamcor Inc. This material is available in a variety of tubular diameters and lengths and may include sealants for securing the plastic coating to the conductor tube.

The tube assembly 26 may be fabricated by inserting the electric conductor tube 41 of the desired length in the same length of heat-shrink plastic, and heating assembly to about 250° F or other temperature specified by the manufacturer. The plastic tube 42 forms a tight fit about the conductor tube 41. If sealant is used, the plastic tube 42 becomes mechanically bonded to the conductor tube 41.

The insulated tube 26 can be made in continuous lengths or made in sections with insulated coupling means being provided at the junctions of section ends.

The size relationship between the plastic tube 42 and conductor tube 41 and procedure for applying the former to the latter may be in accordance with manufacturer's instructions.

As mentioned previously, the lower end of tube 26 is supported within housing 35 and conductor tube 41 is electrically connected to instrument 21. The support housing 35 includes an outer metal sleeve 49 provided with top and bottom closures 50 and 51 secured by suitable fasteners. In order to accommodate the change in volume as the wire 27 is withdrawn from the interior of tube 26, it is preferred that the housing 35 also include a resilient sleeve 52 filled with oil. Ports 53 formed in housing 35 provides pressure communication between the pipe string 12 and the interior of housing 35. As wire 27 is withdrawn from tube 26, oil will be forced from the interior of rubber sleeve 52 upwardly into tube 26.

The lower end of tube 26 extends through a suitable opening formed in closure member 50 and is supported within sleeve 49 by assembly 36. Assembly 36 includes a sleeve 54 soldered to tube 41 and a guide bushing 55 which surrounds and is arranged in mating relation with the sleeve 54. A threaded nut 56 maintains the assembly together. A rigid hollow conductor member 60 is soldered to the interior of tube 41 and provides a rigid internal support for the lower end of the tube 41. A plastic or rubber insulation cap 57 fits around the top of assembly 36 and in combination with the rubber sleeve 52 provides insulation for the conductor tube 41 and member within housing 35. A rubber O-ring 58 and a crimping sleeve 59 may also be provided to insure a watertight assembly.

The lower closure 51 has an axial opening formed therein and is provided with a plug type connector 61. An insulated conductor wire 62 interconnects member 60 and plug 61. The contact of plug 61 may be connected to a terminal 63 of the downhole instrument or motor 1. A port 64 formed in member 51 provides means for filling the interior of the sleeve 52 with oil.

As shown in FIG. 3A, the upper end 38 of the tube 26 which houses packing 39 includes a support sleeve 66 soldered to the exterior of tubing 41, guide bushing 67 which retains the packing elements, and nuts 68 and 69 threaded to opposite ends of bushing 67. The exterior of the head end 38 is insulated as at 71 with suitable plastic or rubber material such as heatshrink polyolefin tubing described previously. The insulated wire 27 enters into the interior of tube 41 through packing 39 which maintains a fluid tight seal. The lower end of wire 27 is electrically connected to sliding contact 28 which may be bow springs as illustrated biased outwardly to maintain positive engagement with the inner wall of tube 41.

The packing assembly 39 permits the wire 27 to be withdrawn but retains the oil within tube 41.

The outside diameter of components 35, 26, and 38 should be sufficiently small to pass through the interior of the drill string 12 but not so large as to present excessive flow restriction. In a specific design for drill pipe having 2-13/16 inside diameter, the assembly may have the following dimensions:

housing (35) outside diameter — 1½ inches
tube (26) outside diameter — ½ inch
head end (38) outside diameter — 13/16 inch The apparatus constructed according to the present invention when employed in wellbore telemetry operations is readily adapted to conventional rotary drilling equipment.

Normally, drilling will proceed to the point where it is desired to begin "logging while drilling" operations. At this point, drilling operations are interrupted and the kelly 11 is disconnected from the drill string 12 in the usual manner. Initially the subsurface package which includes the instrument 21 and support housing 35 are lowered into the well on the tube 26. Prior to lowering this assembly into the pipe string 12, oil is introduced into housing 35 and tube 26 through port 64. Port 64 is then closed with a suitable plug. As mentioned previously, the tube 26 may be continuous in which case it is unreeled from its storage drum as the downhole package is lowered within the drill string. The storage drum should be of sufficient diameter to prevent a permanent set in the coiled tubing. The instrument 21 normally will be adapted to be located in a suitable sub in the pipe string near the bit 13. It will be appreciated, however, that the instrument 21 may be integral with the drill pipe, in which case the lower end of the housing 35 may be provided with means for making electrical contact with the instrument 21.

With the instrument 21 properly located, the tube 26 will extend therefrom to the surface. The length, of course, will depend upon the amount of excess conductor desired, but normally will be sufficient to permit one bit run (i.e. the range of 100 to 3000 feet). The upper end of the tube 26 is suspended from the drill pipe 12 which may be achieved by using spider 37 adapted to fit into the box end of a pipe section. The tube 26 should be maintained in tension to prevent column collapse.

The conductor wire 27 is positioned inside the tube 26, with the contact springs 28 being located initially at the lower end of the tube 26. This assembly can be prepackaged such that when delivered to the wellsite it is in condition for running into the well. Thus, with the instrument 21 located at the subsurface location, the upper end of the wire 27, which extends through the packing 39 will be exposed at the surface and will have a connector 32 secured thereto. The drilling equipment may be placed in condition to commence logging while drilling operations by threading the kelly conductor 29 through an additional pipe section, connecting the kelly 11 to the upper end of the pipe section, suspending the pipe section above the pipe string 12, connecting the kelly connector 3 to connector 32, and, finally, screwing the lower end of the additional pipe section to the upper end of the pipe string 12. Electric conductor path between the subsurface instrument 21 and the surface receiver 23 comprises components (from bottom to top) 63, 61, 62, 60, 41, 28, 27, 29, 24 and 33. The return path may include wire 34 and the pipe string 12.

With the equipment properly assembled, the logging while drilling operations may begin. Individual pipe sections may be added to the drill string 12, by the following procedure. With the drill string 12 suspended in the rotary table 16, kelly 11 is disconnected and elevated using the rig hoisting equipment. The conductor wire 27 is pulled upwardly until connectors 3 and 32 are exposed. A support plate (not shown) is used to support the upper end of wire 27 on the drill string 12. Connector 31 is disconnected from connector 32 freeing kelly conductor 29 from wire 27. The kelly conductor 29 is threaded through a pipe section to be added to the drill string (usually located in the shallow borehole below the derrick floor) and this assembly is connected into the pipe string in the manner described previously.

The upward movement of the wire 27 causes the spring contacts 28 to move upwardly within tube 26. The distance of upward movement will depend on the length of the pipe section to be added, but usually will be about 30 feet. As the conductor wire 27 is withdrawn from tube 26, oil within rubber sleeve 52 is forced into the tube 26 maintaining it full.

Figure 2:
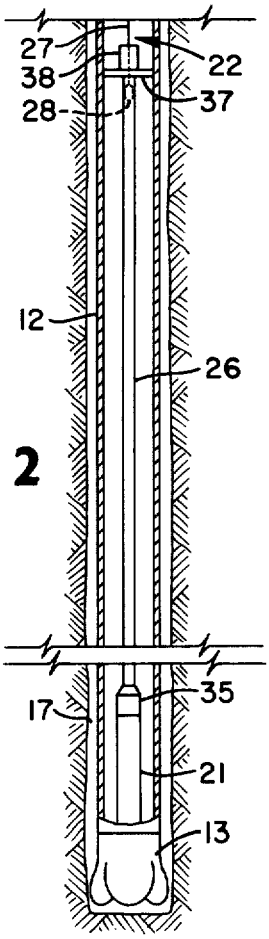
FIG. 2 is a fragmentary view of FIG. 1 illustrating the disposition of the conductor at a time subsequent to that illustrated in FIG. 1.

Drilling may proceed in the manner described until a sufficient number of pipe sections have been added to cause the sliding contacts 28 to reach the upper end of tube 26 (see FIG. 2). At this time, the apparatus may be withdrawn by reeling in wire 27 and tube 26. (The spider 37 can be constructed to permit upward movement of the tube 26 and support 35.) Alternatively, the wire 27 within tube 26 may be provided with weights to cause the contacts to return to its lower position. A wire section may be connected to connector 32 and fed into the pipe string 12 to lower contacts 28 within tube 26.

Although the present invention has been described with reference to wellbore telemetry operations, the apparatus may also be employed in downhole electric drilling systems. Electric drilling normally uses a three phase motor which requires three separate conductor wires from the surface to the downhole motor. The present invention may be modified simply by providing three conductor wires from the motor to the tube which may be divided to provide three separate longitudinally extending conductor strips. These strips are insulated from one another. A suitable structure is a square or triangular plastic tube having conductor strips mounted in each corner. The conductor wire may include three conductors which pass into the tube. Each conductor is provided with a spring loaded contact which is adapted to engage one of the conductor strips. The three conductor wires extend to the surface and may be connected to a power source by means of conventional slip ring assemblies.

In addition to the above described applications, it will be realized that the invention may be used with other types of drilling equipment, including turbodrills and positive displacement hydraulic motors. These devices normally include a motor or turbine mounted on the lower end of the drill string and adapted to connect and drive a bit. The motor turbine powered by the drilling fluid powers the drill bit while the drill string remains stationary. When this type of subsurface drilling device is used in directional drilling operations, the present invention provides a highly useful means for transmitting directional data to the surface.

We claim:

1. Apparatus for maintaining electric continuity between a subsurface terminal and a surface terminal within a pipe string which comprises:

an externally insulated conductor tube adapted to be mounted in said pipe string and extending upwardly from said subsurface terminal through a portion, at least, of said pipe string; and an insulated conductor wire having its lower end disposed within said tube and being in electrical contact with the interior of said tube, said conductor wire extending upwardly from said tube to said surface location, and being telescopically movable with respect to said tube, electric continuity being maintained during telescopic movement.

2. Apparatus as defined in claim 1 wherein said lower end of said wire is provided with an electric contact adapted to slidingly engage the interior of said tube.

3. Apparatus as defined in claim 2 wherein said tube is oil filled and includes a packing at its upper end for maintaining a seal between said wire and said tube.

4. Apparatus as defined in claim 1 wherein said tube is insulated with a heat-shrink polyolefin.

5. A wellbore telemetry apparatus for a pipe string which includes a subsurface instrument mounted in said drill string and adapted to detect a subsurface condition and generate an electric signal indicative of that condition; and a device for receiving said electric signal, and an electric conductor interconnecting the instrument and the device; the improvement wherein said electric conductor comprises an externally insulated conductor tube extending upwardly from said subsurface instrument through a portion, at least, of said pipe string; an insulated conductor wire mounted in said tube and extending through the upper end of said tube upwardly to the surface said wire being separable at the surface to permit the addition of a pipe section to the pipe string; contact means mounted on the lower end of said wire and providing a movable contact between said wire and the interior of said tube; and means for moving said wire relative to said tube.

6. Apparatus as defined in claim 5 wherein said apparatus further includes means for supporting the upper end of said tube on said pipe string.

7. Apparatus as defined in claim 5 wherein said tube includes an outer coating of shrink-fit plastic material.

8. Apparatus as defined in claim 5 wherein the length of conductor wire disposed within the conductor tube is between about 100 and 3000 feet.

9. Apparatus as defined in claim 5 wherein said contact means provide outwardly biased sliding contact member.

10. An electric drilling system which includes a subsurface motor mounted within a drill string and a surface power source, an improved conductor system for maintaining electric continuity as individual pipe sections are added to the drill string, said conductor system comprising:

an externally insulated conductor tube mounted within said drill string and extending through a portion thereof, said tube having a length greater than the length of an individual pipe section;

means for electrically connecting said tube to said motor;

an insulated conductor wire having a lower end disposed within said tube and extending upwardly to the surface;

contact means mounted on said lower end for providing a movable contact on the interior of said tube; and means for elevating said conductor wire relative to said tube, said movable contact maintaining electric continuity during such movement, thereby permitting additional pipe sections to be added to said drill string.

11. Apparatus as defined in claim 10 wherein said motor is a three phase motor, said conductor tube includes three conductor strips extending longitudinally therethrough, said conductor wire includes three conductor strands, and said contact means includes three separate movable contacts for maintaining electric contact between said three conductor strands and said conductor strips.

* * * * *